US006176694B1

(12) United States Patent
Fang et al.

(10) Patent No.: US 6,176,694 B1
(45) Date of Patent: Jan. 23, 2001

(54) DOUBLE SCREW ROTOR ASSEMBLY

(75) Inventors: Hong-Sheng Fang, Hsinchu Hsien; Zhang-Hua Fong, Chiayi Hsien; Hann-Tsong Wang, Hsinchu Hsien; Cheng-Chan Tsai, Hsinchu Hsien; Jiun-Hung Chen, Hsinchu Hsien; Ming-Fong Chen, Hsinchu, all of (TW)

(73) Assignee: Industrial Technology Research Institute (TW)

( * ) Notice: Under 35 U.S.C. 154(b), the term of this patent shall be extended for 0 days.

(21) Appl. No.: 09/372,674

(22) Filed: Aug. 12, 1999

(30) Foreign Application Priority Data

May 7, 1999 (TW) ..... 88207312

(51) Int. Cl.[7] ..... F03C 2/00
(52) U.S. Cl. ..... 418/194
(58) Field of Search ..... 418/194

(56) References Cited

U.S. PATENT DOCUMENTS 3,180,559 * 4/1965 Boyd ..... 418/194
5,533,887 * 7/1996 Maruyama et al. ..... 418/201.3
5,667,370 9/1997 Im .
6,019,586 * 2/2000 Liou ..... 418/194

FOREIGN PATENT DOCUMENTS

384355 * 12/1932 (GB) ..... 418/194
401267384 * 10/1989 (JP) ..... 418/194
406307360 * 11/1994 (JP) ..... 418/194

* cited by examiner

*Primary Examiner*—Thomas Denion
*Assistant Examiner*—Theresa Trieu
(74) *Attorney, Agent, or Firm*—Smith, Gambrell & Russell, LLP

(57) ABSTRACT

A power-saving, low-noise double screw rotor assembly, which includes a casing and a pair of screw rotors, wherein the casing has an inside wall defining a compression chamber, an inlet port and an outlet port communicating with the compression chamber. The screw rotors are mounted in the compression chamber and meshed together, each having a spiral thread around the periphery. The thread defines an equidistant pitch. The addendum of the thread defines an outside diameter and is abutted against the inside wall of the casing, the dedendum defines a root diameter. A thread height is defined between the addendum of thread and the dedendum of thread, the thread height gradually reduces in direction from the inlet port toward the outlet port. The dedendum of thread and side walls of the thread of each screw rotor define with the inside wall of the casing at least one transfer chamber having a volume gradually reducing in direction from the inlet port toward the outlet port.

9 Claims, 6 Drawing Sheets

Prior Art

Prior Art

Prior Art

DOUBLE SCREW ROTOR ASSEMBLY

BACKGROUND OF THE INVENTION

The present invention relates to a double screw rotor assembly, and more particularly to such a double screw rotor assembly which is suitable for use in a fluid pressure changer means, such as water or air pumps, compressors, etc.

FIGS. 4 and 5 show a traditional double screw rotor assembly. This structure of double screw rotor comprises a casing 5 defining a compression chamber 51, two screw rotors 6 meshed inside the compression chamber 51. Because the thread 60 of each rotor 6 has constant pitch P and same cross-sectional profile, the volume of each transfer chamber 52 does not vary with the operation of the two screw rotors 6. Because the volume of transfer chamber 52 is not variable, a high pressure difference occurs at the outlet end 512 during the operation of the screw rotors 6, and this high pressure difference results in a reverse flow of fluid, high noises, and waste of energy.

U.S. Pat. No. 5,667,370 discloses another structure of double screw rotor assembly as shown in FIG. 6. According to this design, the thread 61 of each screw rotor 60 has an uneven pitch $P_1$,$P_2$, and the pitch $P_1$,$P_2$ is reduced in proper order from the inlet end 513 toward the outlet end 514 ($P_1$>$P_2$), therefore the volume of respective chamber 53 or 54 are gradually reduced in same direction. However, the non-uniform pitch type of thread 61 defines different cross-sectional profiles and pressure angles at different elevations. These limitations cause the thread 61 difficult to be produced. When processing the thread 61, a particularly designed cutting-metal working machine must be used. This complicated thread processing process greatly increases the manufacturing cost of the double screw rotor assembly.

SUMMARY OF THE INVENTION

The present invention has been accomplished to provide a double screw rotor assembly which eliminates the aforesaid drawbacks. It is one object of the present invention to provide a double screw rotor assembly which effectively reduces reverse flow at the outlet end, so as to reduce power consumption and operation noises. It is another object of the present invention to provide a double screw rotor assembly which is easy and inexpensive to be manufactured.

According to one aspect of the present invention, the double screw rotor assembly comprises a casing, and two screw rotors. The casing comprises an inside wall defining a compression chamber, an inlet port and an outlet port respectively disposed in communication with said compression chamber. The screw rotors are mounted in the compression chamber inside the casing and meshed with each other. The addendum of screw rotor defines an outside diameter abutted against the inside wall of the casing. The dedendum of screw rotor defines a root diameter. A thread height is defined between the addendum of thread and the dedendum of thread, i.e. between the outside diameter and the root diameter. Further, at least one transfer chamber is defined within the casing and surrounded by the inside wall of the casing and groove of each of the screw rotors. The at least one transfer chamber which's volume gradually reducing in direction from the inlet port toward the outlet port. According to another aspect of the present invention, the gradually reduced design of the volume of the at least one transfer chamber is achieved by gradually and linearly/non-linearly increasing the root diameter, or reducing the outside diameter in direction from the inlet/port toward the outlet port. According to still another aspect of the present invention, the screw rotors can have more than one thread. The thread of each screw rotor can be made defining an equidistant pitch, or having a uniform cross-sectional profile, so that the thread can easily and inexpensively be processed.

DETAILED DESCRIPTION OF THE PREFERRED EMBODIMENT

Figure 1:
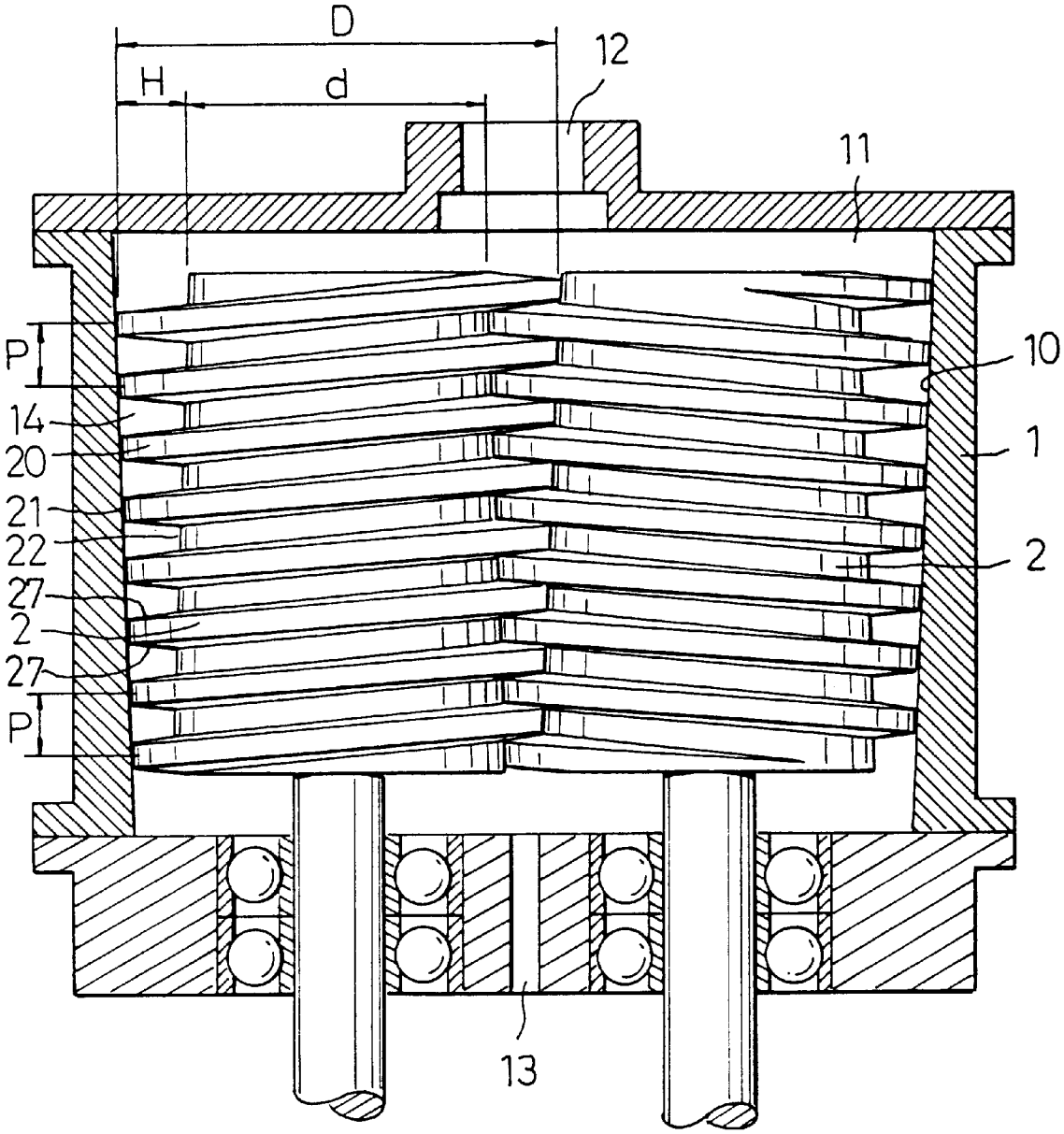
FIG. 1 is a sectional view of a double screw rotor assembly according to one embodiment of the present invention.

Referring to FIG. 1, a double screw rotor assembly according to a first embodiment of the present invention is shown comprised of a casing 1. The casing 1 comprises a compression chamber 11 defined within the inside wall 10 thereof, an inlet port 12 and an outlet port 13 at two opposite ends thereof in communication with the compression chamber 11. Two screw rotors 2 meshed together, and mounted inside the compression chamber 11. Each screw rotor 2 comprises a spiral thread 20 raised around the periphery. The addendum2l of the thread 20 defines an outside diameter D. The dedendum 22 of the thread 20 defines a root diameter d. As illustrated, the outside diameter D abuts against the inside wall 10 of the casing 1. A thread height H is defined between the addendum of thread 21 and the dedendum of thread 22. The pitch P of the thread 20 is equals anywhere (constant pitch).

As shown in the drawing of FIG. 1, the thread height H linearly and gradually reduces in direction from the inlet port 12 toward the outlet port 13, i.e., the root diameter d linearly and gradually increases in direction from the inlet port 12 toward the outlet port 13. The outside diameter D and the inner diameter of the inside wall 10 of the casing 10 also linearly and gradually reduce in direction from the inlet port 12 toward the outlet port 13. Therefore, the volume of the multiple transfer chambers 14, which are defined between the inside wall 10 of the casing 1 and the side walls 27 and dedendum 22 of the thread 20 of each of the screw rotors 2, linearly and gradually reduce in direction from the inlet port 12 toward the outlet port 13 during the transfer process of the screw rotors 2. This arrangement achieves a uniform variation of fluid pressure at the outlet port 13, therefore the reverse flow, the noises, as well as the consumption of power are minimized.

As indicated above, the thread 20 has a uniform cross-sectional profile i.e. a trapezoidal thread, therefore the thread 20 can easily be produced by a numerical control (NC) cutting-metal working machine with lower cost.

Figure 2:
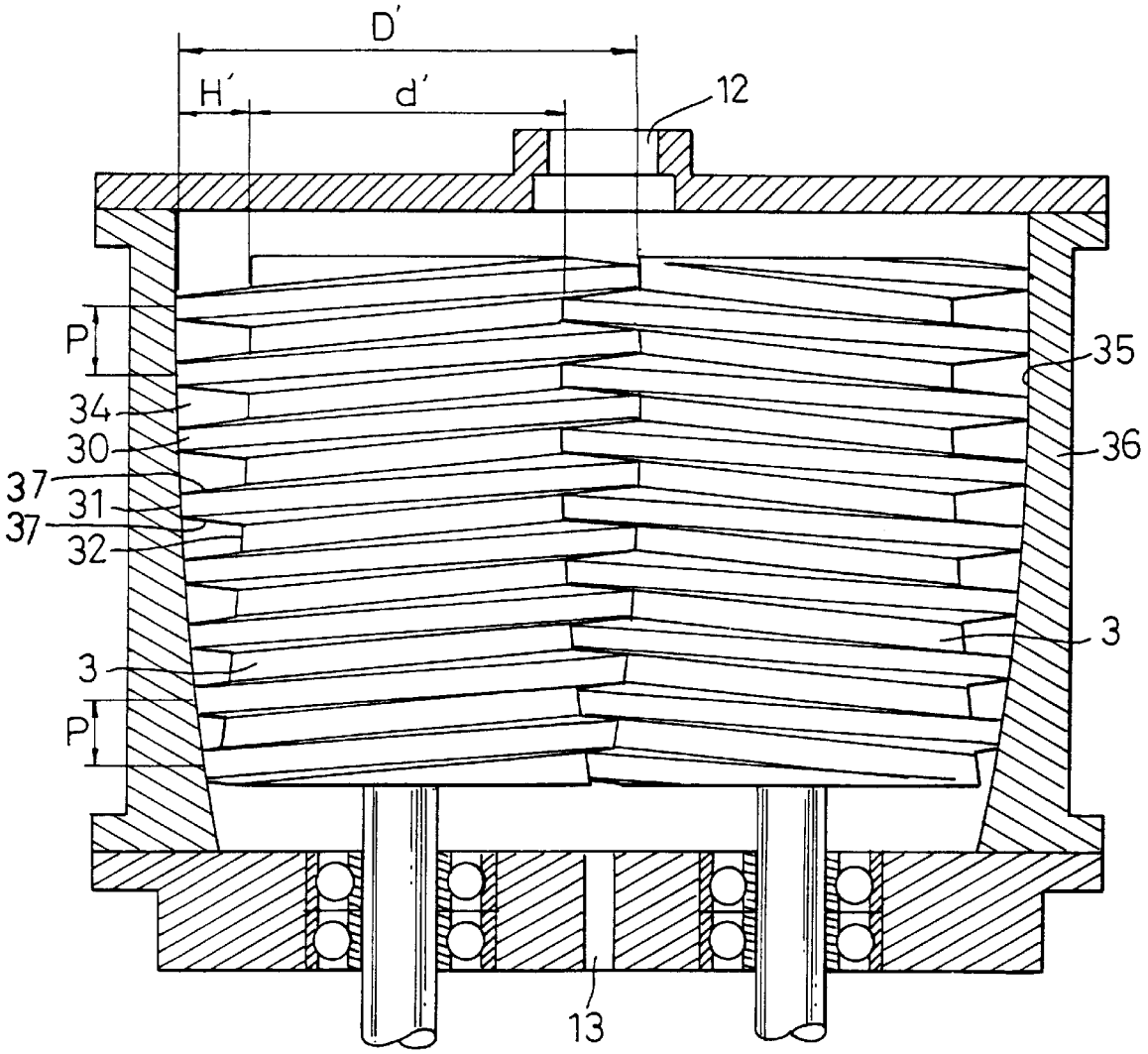
FIG. 2 is a sectional view of a double screw rotor assembly according to a second embodiment of the present invention.

FIG. 2 illustrates a double screw rotor assembly according to a second embodiment of the present invention. This embodiment comprises a casing 36, and two screw rotors 3 meshed together and mounted inside the casing 36. The screw rotors 3 each comprise a spiral thread 30. The addendum of thread 31 of the thread 30 of each screw rotor 3 abuts against the inside wall 35 of the casing 36. Multiple transfer chambers 14 are defined between the inside wall 35 of the casing 36 and the side walls 37 and dedendum of thread 32 of the thread 30 of each of the screw rotors 3. As illustrated, the thread 30 has an equidistant pitch P, and the thread height H' gradually reduces in direction from the inlet port 12 toward the outlet port 13, however, the root diameter d' and outside diameter D' of each screw rotor 3 are not uniform, i.e., the root diameter d' non-linearly and gradually increases in direction from the inlet port 12 toward the outlet port 13, forming a concave curve, and the outside diameter D' of the thread 30 and the inner diameter of the inside wall 35 of the casing 3 non-linearly and gradually reduce in direction from the inlet port 12 toward the outlet port 13, forming a convex curve. Therefore, the volumes of the air transfer chambers 34 gradually reduce in direction from the inlet port 12 toward the outlet port 13.

Figure 3:
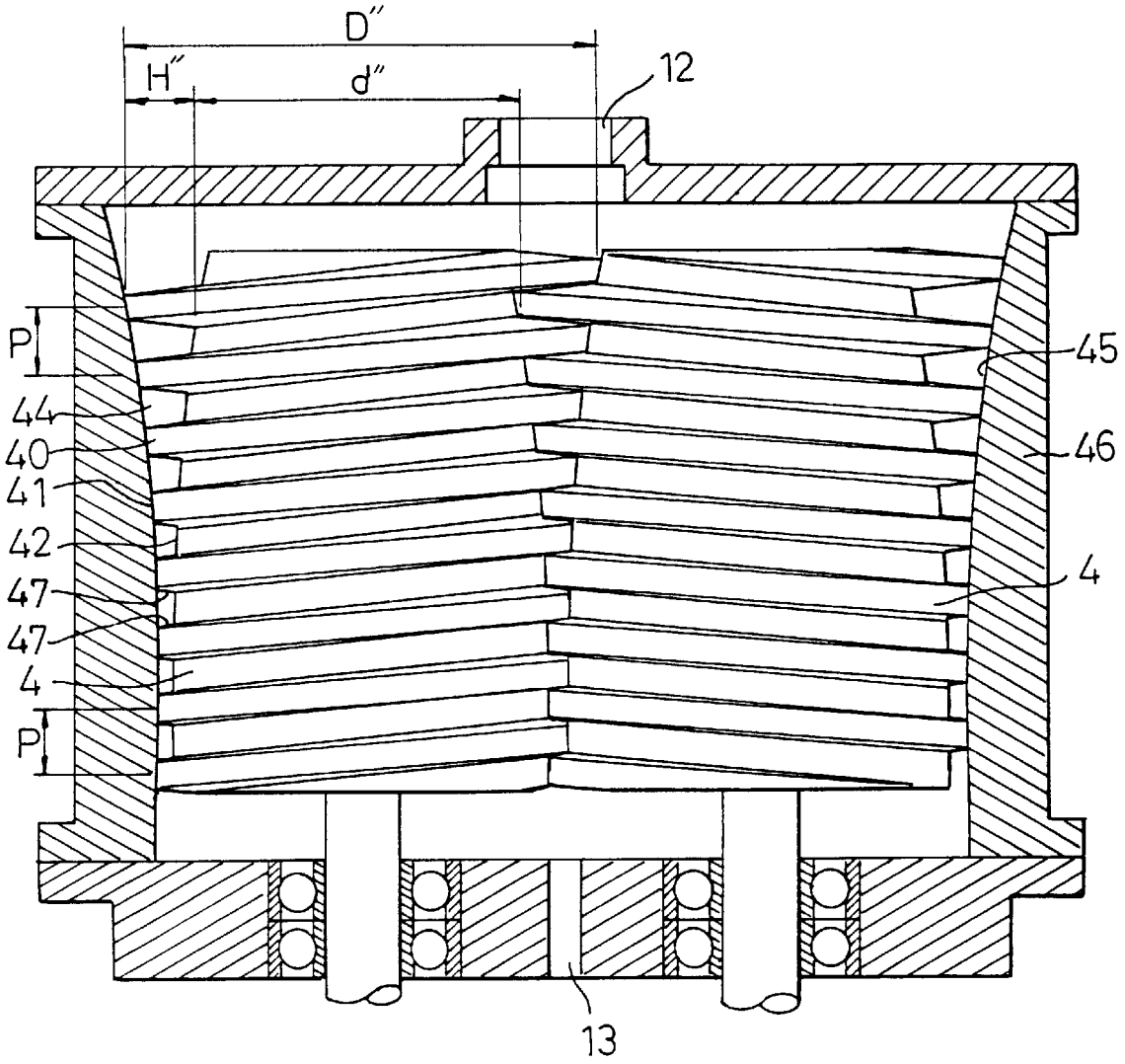
FIG. 3 is a sectional view of a double screw rotor assembly according to a third embodiment of the present invention.
Figure 4:
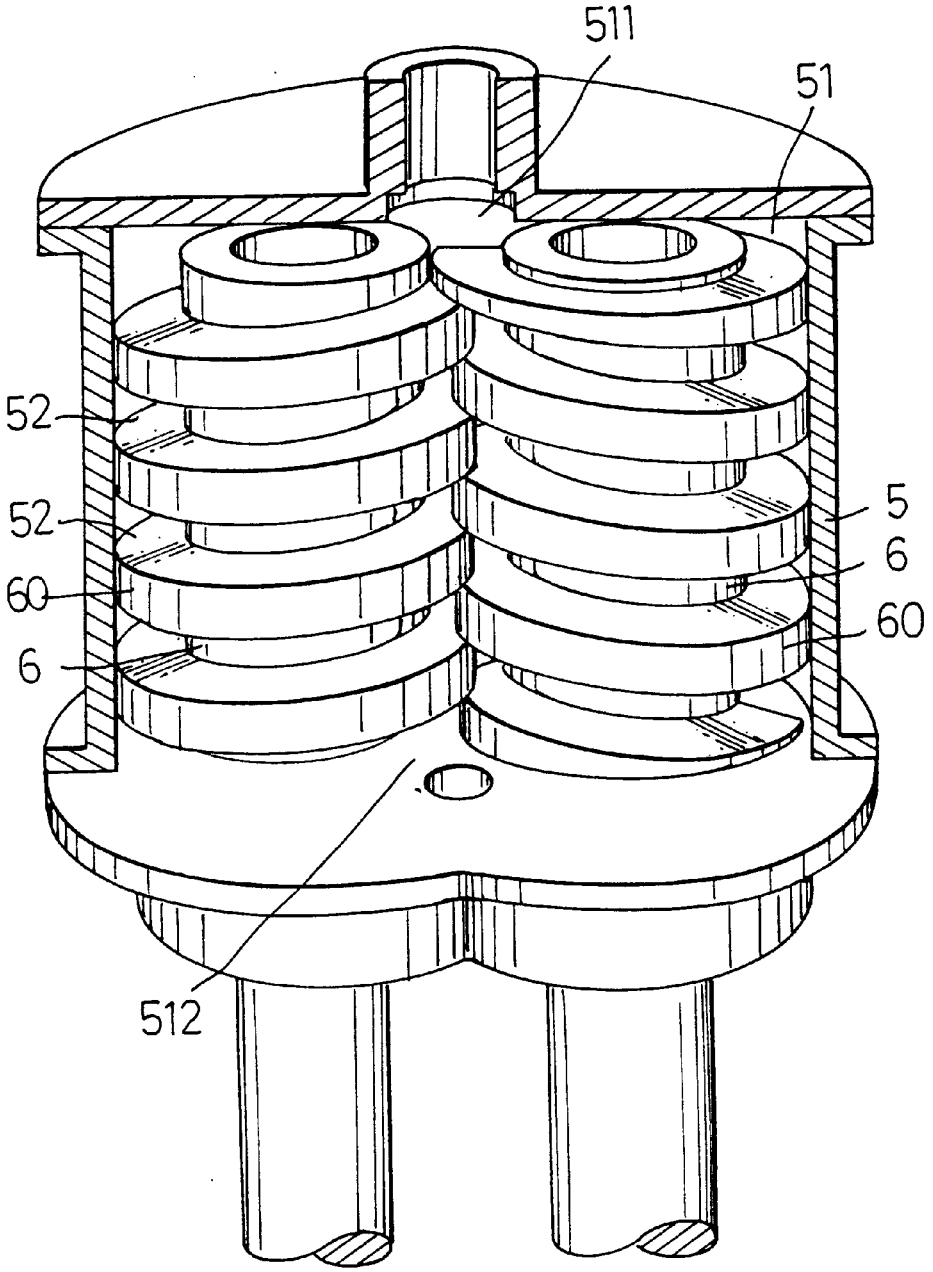
FIG. 4 is a perspective view of a double screw rotor assembly according to the prior art.
Figure 5:
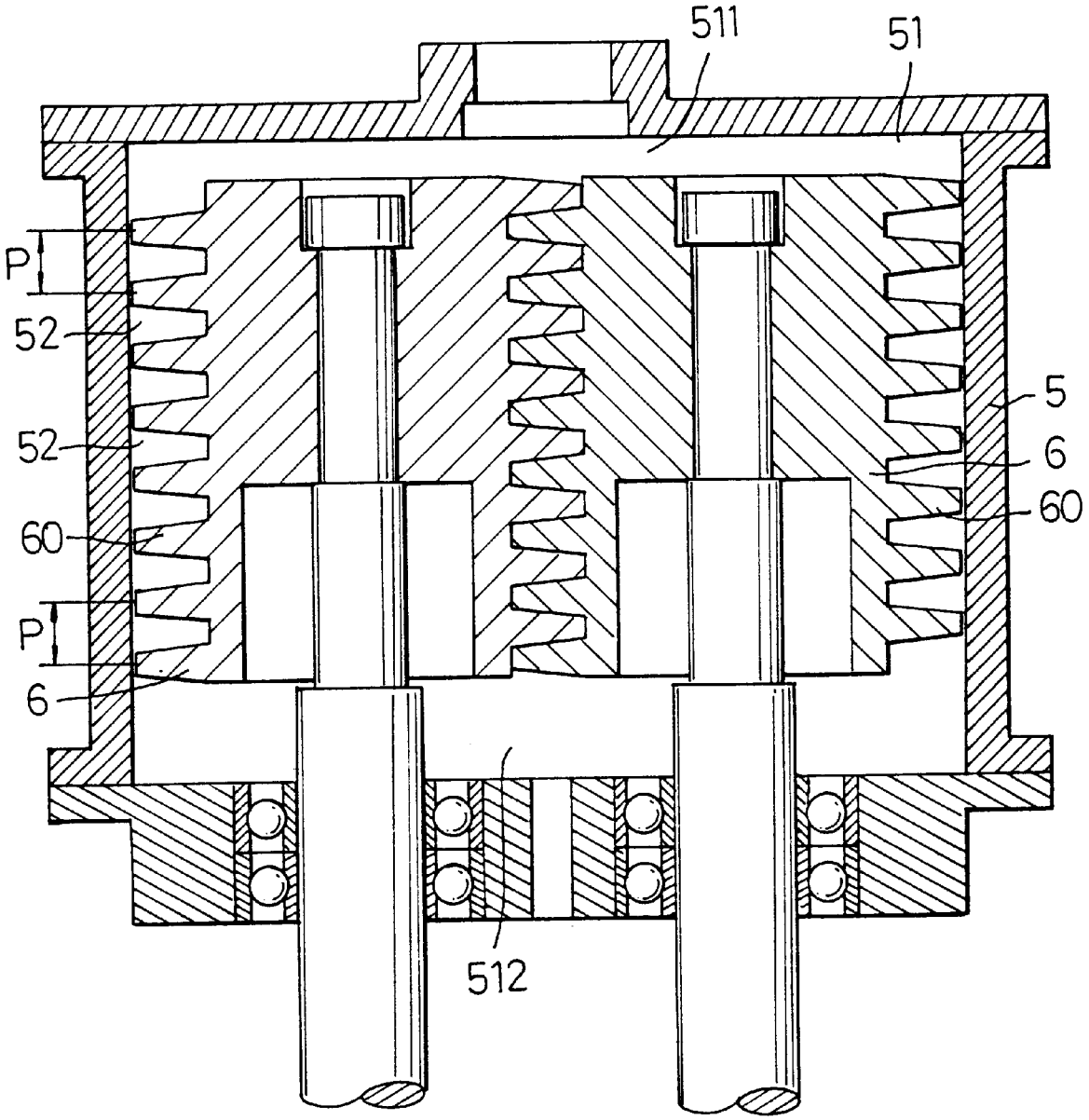
FIG. 5 is a sectional view of the double screw rotor assembly shown in FIG. 4.
Figure 6:
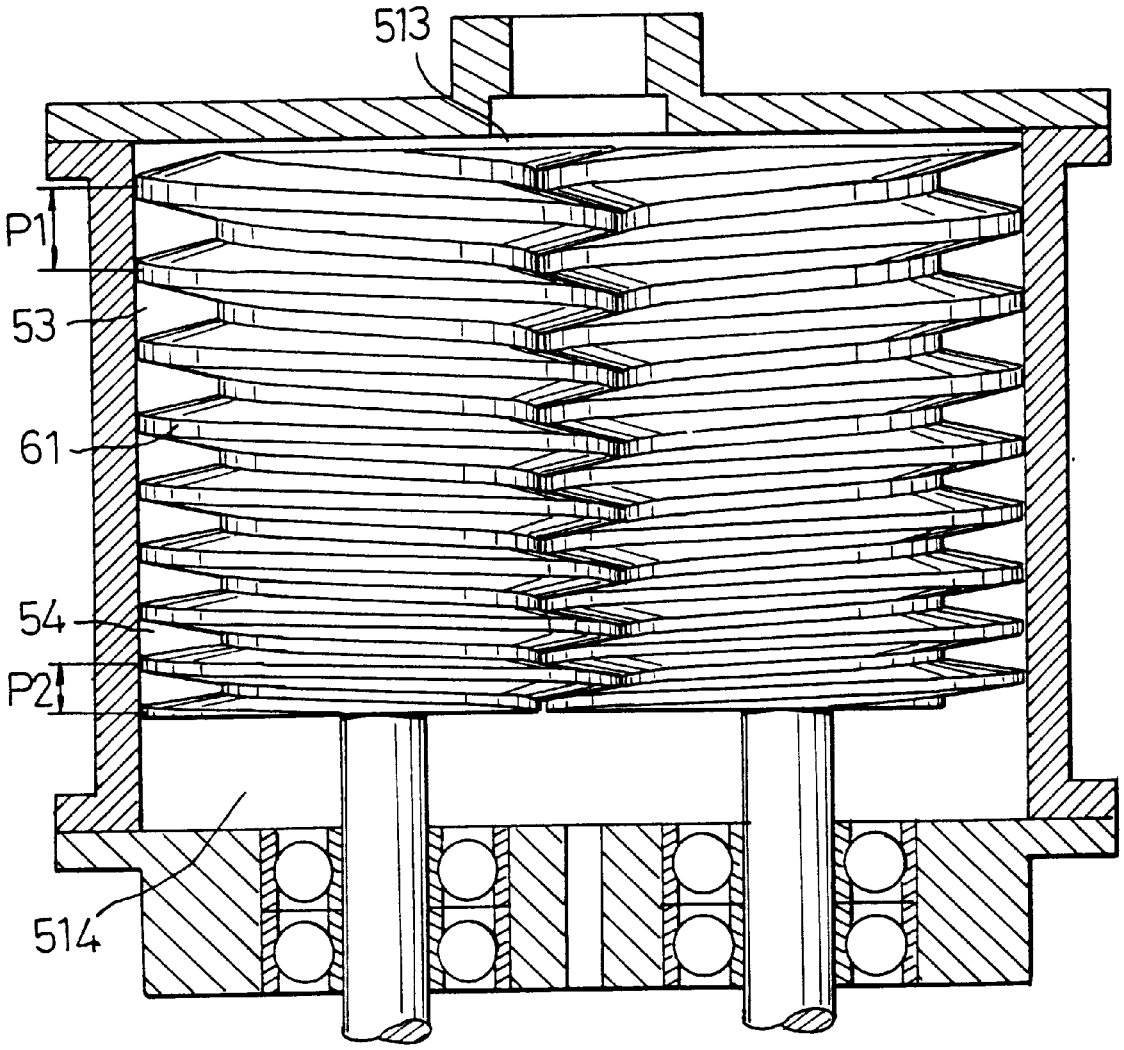
FIG. 6 is a sectional view of another structure of double screw rotor assembly according to the prior art.

The aforesaid non-linear variation of configuration can be modified subject to different revolving speed or different fluid characteristics. For example, in the embodiment shown in FIG. 3, two screw rotors 4 are meshed together and mounted inside a casing 46. The screw rotors 4 each have a spiral thread 40 around the periphery. The addendum of thread 41 of the thread 40 of each of the screw rotors 4 is respectively abutted against the inside wall 45 of the casing 46. Multiple fluid transfer chambers 44 are defined between the inside wall 45 of the casing 46 and the side walls 47 and dedendum of thread 42 of the thread 40 of each of the screw rotors 4. As illustrated in FIG. 3, the thread 40 has a constant pitch P, and the thread height H" gradually reduces in direction from the inlet port 12 toward the outlet port 13, however, the root diameter d" and outside diameter D" of each screw rotor 4 are not uniform, i.e., the root diameter d" non-linearly and gradually increases in direction from the inlet port 12 toward the outlet port 13, forming a convex curve, and the outside diameter D" of the thread 40 and the inner diameter of the inside wall 45 of the casing 4 non-linearly and gradually reduce in direction from the inlet port 12 toward the outlet port 13, forming a concave curve. Therefore, the volumes of the fluid transfer chambers 44 gradually reduce in direction from the inlet port 12 toward the outlet port 13.

It is to be understood that the drawings are designed for purposes of illustration only, and are not intended as a definition of the limits and scope of the invention disclosed.

What the invention claimed is:

1. A double screw rotor assembly comprising:

a casing, said casing comprising an inside wall defining a compression chamber, an inlet port and an outlet port respectively disposed in communication with said compression chamber;

two screw rotors mounted in the compression chamber inside said casing and meshed with each other, said screw rotors each comprising a spiral thread around the periphery, said thread having a addendum of thread defining an outside diameter and abutted against the inside wall of said casing, a dedendum of thread defining a root diameter which non-linearly and gradually increases in a direction from said inlet port toward said outlet port, and a thread height defined between said addendum of thread and said dedendum of thread; and at least one transfer chamber defined within said casing and surrounded by the inside wall of said casing and side walls and dedendum of the thread of each of said screw rotors, said at least one transfer chamber having a volume gradually reducing in direction from said inlet port toward said outlet port.

2. The double screw rotor assembly of claim 1 wherein said non-linearly and gradually increased root diameter defines a concave curve curving in direction from said inlet port toward said outlet port.

3. The double screw rotor assembly of claim 1 wherein said non-linearly and gradually increased root diameter defines a convex curve curving in direction from said inlet port toward said outlet port.

4. A double screw rotor assembly comprising:

a casing, said casing comprising an inside wall defining a compression chamber, an inlet port and an outlet port respectively disposed in communication with said compression chamber;

two screw rotors mounted in the compression chamber inside said casing and meshed with each other, said screw rotors each comprising a spiral thread around the periphery, said thread having a addendum of thread defining an outside diameter which non-linearly and gradually reduces in direction from said inlet port toward said outlet port and said thread being abutted against the inside wall of said casing, a dedendum of thread defining a root diameter, and a thread height defined between said addendum of thread and said dedendum of thread; and at least one transfer chamber defined within said casing and surrounded by the inside wall of said casing and side walls and dedendum of the thread of each of said screw rotors, said at least one transfer chamber having a volume gradually reducing in direction from said inlet port toward said outlet port.

5. The double screw rotor assembly of claim 4 wherein said non-linearly and gradually reduced outside diameter defines a concave curve curving in direction from said inlet port toward said outlet port.

6. The double screw rotor assembly of claim 4 wherein said non-linearly and gradually reduced outside diameter defines a convex curve curving in direction from said inlet port toward said outlet port.

7. A double screw rotor assembly comprising:

a casing, said casing comprising an inside wall defining a compression chamber, an inlet port and an outlet port respectively disposed in communication with said compression chamber, and wherein the inside wall of said casing defines an inner diameter which non-linearly and gradually reduces in direction from said inlet port toward said outlet port;

two screw rotors mounted in the compression chamber inside said casing and meshed with each other, said screw rotors each comprising a spiral thread around the periphery, said thread having a addendum of thread defining an outside diameter and abutted against the inside wall of said casing, a dedendum of thread defining a root diameter, and a thread height defined between said addendum of thread and said dedendum of thread; and at least one transfer chamber defined within said casino and surrounded by the inside wall of said casing and side walls and dedendum of the thread of each of said screw rotors, said at least one transfer chamber having a volume gradually reducing in direction from said inlet port toward said outlet port.

8. The double screw rotor assembly of claim 7 wherein the non-linearly and gradually reduced inner diameter of said casing defines a convex curve curving in direction from said inlet port toward said outlet port.

9. The double screw rotor assembly of claim 7 wherein the non-linearly and gradually reduced inner diameter of said casing defines a concave curve curving in direction from said inlet port toward said outlet port.

* * * * *